US006941623B2

(12) United States Patent
Brorens et al.

(10) Patent No.: US 6,941,623 B2
(45) Date of Patent: Sep. 13, 2005

(54) FINISHING TREATMENT FOR PILE CARPETS

(75) Inventors: Peter Hendrik Brorens, Christchurch (NZ); Cornelis Jan Van Lujik, Christchurch (NZ)

(73) Assignee: Wool Research Organisation of New Zealand, Inc., Lincoln (NZ)

( * ) Notice: Subject to any disclaimer, the term of this patent is extended or adjusted under 35 U.S.C. 154(b) by 0 days.

(21) Appl. No.: 10/237,964

(22) Filed: Sep. 10, 2002

(65) Prior Publication Data

US 2003/0068464 A1 Apr. 10, 2003

Related U.S. Application Data

(63) Continuation of application No. PCT/NZ00/00024, filed on Mar. 10, 2000.

(51) Int. Cl.[7] ..... D06C 29/00; D06C 27/00; D06C 15/00

(52) U.S. Cl. ..... 26/2 R; 38/1 R; 38/2; 38/3

(58) Field of Search ..... 428/92, 89; 26/2 R; 38/1 R, 2, 3, 44, 57

(56) References Cited

U.S. PATENT DOCUMENTS 4,670,317 A 6/1987 Greenway 6,020,031 A 2/2000 Pilling et al.

FOREIGN PATENT DOCUMENTS

| | | | | |
|---|---|---|---|---|
| EP | 453630 A1 | * | 10/1991 | ..... D06C/17/02 |
| JP | 53074190 A | * | 7/1978 | ..... A47G/27/02 |
| JP | 04102413 A | * | 4/1992 | ..... A47G/27/02 |
| NZ | 238302 A | * | 6/1995 | ..... D06C/15/02 |

* cited by examiner

*Primary Examiner*—Cheryl A. Juska
(74) *Attorney, Agent, or Firm*—Dykema Gossett PLLC

(57) ABSTRACT

An improved finishing treatment for pile carpets is described. The improvement lies in providing a method and apparatus for producing a controlled manner, uniform and unidirection pile lean, and to stabilize the pile lean with that orientation to restrict reversal of the pile lean during actual use of the carpet on the floor. One method of the invention is to transport the pile carpet past a pre-orientation brush or roller, through a pair of compression rollers that cause the pile to lean in the trailing direction whilst subjecting the pile to a compression cycle. The improved treatment may be applied to both cut and loop pile carpets and may find application in carpet manufacture, making the carpet resistant to pile reversal in use and reducing the propensity of the carpet to shade in an objectionable manner.

5 Claims, 1 Drawing Sheet

FINISHING TREATMENT FOR PILE CARPETS

CROSS-REFERENCE TO RELATED APPLICATION

This is a continuation of International Application No. PCT/NZ00/00024, filed 10 Mar. 2000, the priority of which is hereby claimed.

FIELD OF THE INVENTION

This invention relates to an improved finishing treatment for pile carpets.

BACKGROUND TO THE INVENTION

Pile carpets and methods of manufacture for carpets with improved finishing treatments have been the subject of a number of patent specifications including the Applicant's patent specification No. PCT/NZ98/00181 the description of which is incorporated herein by way of background.

After work done at the Applicant's research facility on the cause of shading, it was established that if the pile lean could be made more persistent so that it does not just lean over in any direction, depending on a few random footsteps, some types of pile-reversal might be prevented. After preliminary investigations into various methods of leaning the pile over and setting into a more permanent position, a promising method was found, as described herein.

It is an object of the present invention to so treat and condition a carpet to produce in the pile that state of pile lean normally manifested by the appearance of shading but with all the pile leaning substantially in one direction.

It is a further object of the invention to provide a method and apparatus of producing in a controlled manner uniform and unidirectional pile lean and to stabilise the pile lean with that orientation and to restrict reversal of the pile lean during actual use on the floor.

SUMMARY OF THE INVENTION

According to a first aspect of the invention there is provided a method of laying the pile of a carpet uniformly in one direction and stabilising the pile in its leaning orientation, the method including the steps of:

- treating a carpet to pre-orientation to lay a pile in a preferred direction;
- spraying water evenly onto the carpet;
- squeezing the carpet between pressure rollers, one of which is heated, to induce a preferred lean to the pile; and
- setting at least temporarily the pile in the preferred orientation.

According to a second aspect of the invention there is provided means for laying, treating and compressing a pile in a preferred orientation. The method and means can be incorporated in a carpet finishing line.

The process is relatively simple and consists of four elements:

- a pre-orientation
- spraying
- flattening
- setting.

According to another aspect of the invention, there is a pile carpet which has undergone an aforementioned process to lay the pile in a uniform direction and stabilise the lay of the pile so that it is resistant to reversal in use, thereby reducing its propensity to shade or watermark in an objectionable manner.

According to another aspect of the invention, there is a pile carpet which has undergone an aforementioned process to lay the pile in a uniform direction and stabilise the lay of the pile so that it is resistant to reversal in use thereby reducing its propensity to shade or watermark in an objectionable manner.

Further aspects of the invention will become apparent from the following description which is given by way of example only.

BRIEF DESCRIPTION OF THE DRAWINGS

The present invention will now be described by way of example only with reference to the attached drawing in which.

DESCRIPTION OF THE PREFERRED EXAMPLE

Figure 1:
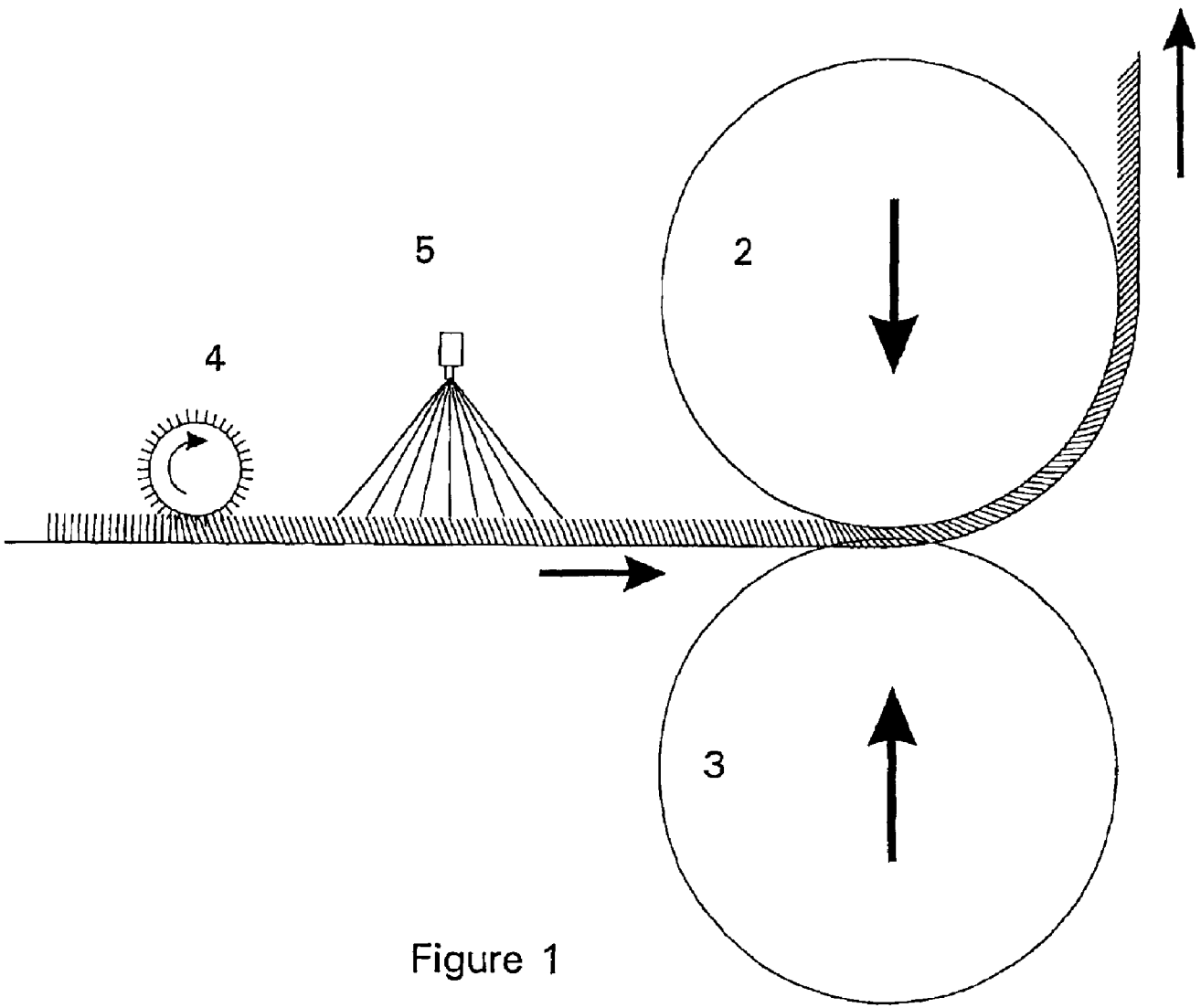
FIG. 1: depicts diagrammatically, in side elevation, a series of rollers arranged and designed to create in a carpet resistance to pile-reversal (shading).

Referring now to FIG. 1, a pile carpet 1 is transported in the direction of the arrows shown through a pair of squeeze rollers 2 and 3.

The pair of squeeze rollers 2, 3, of which the top roller 2 is heated, is used to both push over the pre-oriented pile and to set the pile into a configuration where it has a definite lean.

Page 6, replace the paragraph starting at line 9 and ending at line 11 with the following paragraph.

To determine the effect of the amount of water sprayed onto the carpet has on the effectiveness of the treatment, a special trial was carried out which also took different levels of roller temperature into account.

The pair of squeeze rollers, 2, 3 of which the top roller 2 is heated is used to both push over the pre-oriented pile and to set the pile into a configuration where it has a definite lean.

The pile carpet is subjected to pre-orientation by a roller 4 in accordance with parameters described below.

The carpet 1 is sprayed with water by a water sprayer 5 between the pre-orientation roller 4 and the rollers 2, 3. Parameters and guidelines for the water spraying are described below.

The treatment developed by the Applicant gives carpets a certain amount of resistance to pile-reversal (shading). The treatment generally will take place in a carpet finishing line because it needs a subsequent drying and a shearing treatment. The level of treatment can be readily adjusted, but there is a certain trade-off between appearance and level of pile-reversal resistance.

The first two steps are relatively simple preliminary processes, but correct application is vital to the success of the treatment. The pre-orientation process lays the pile in the preferred direction so that when the pile is flattened it is done in the right direction. Earlier on it was found that some carpets showed a considerable amount of what, for want of a better term, may be called lambstails. This seemed a very serious problem until it was found that by brushing or scraping the sample in the direction of the original pile-lay this phenomenon diminished dramatically. This undesirable side-effect appears to be caused by tufts which are upright or even leaning forward are not pushed backward by the roller, but are buckled or pushed the wrong way. These tufts are then very clearly distinguishable from the majority of tufts which have been flattened in the other direction. Fortunately only a very mild form of pre-orientation before rolling is necessary to abolish this problem.

For this purpose a rotary bristle brush similar to brushes already used on carpet finishing lines can be used as the pre-orientation roller 4.

In the spraying process a certain amount of water is sprayed evenly onto the carpet. It is of the utmost importance that the water is sprayed on evenly otherwise serious appearance problems in the new carpet can occur apart from local ineffectiveness of the treatment. This calls for a reasonably sophisticated spraying setup which for example can take account of variation in the speed of the carpet in the finishing line.

No significant advantage seems to be gained by using a wetting agent in the water to ensure better penetration of the moisture in the pile. Spraying plain water on the carpet which causes small droplets to sit on the surface of the pile appears to yield better results than any other method of pre-wetting including steaming. The probable explanation of the optimal performance of water on the surface of the carpet is that when the surface of the carpet touches the hot roller 2 the droplets are immediately evaporated and the ensuing steam is forced into the pile because there is nowhere else to go. There is no other simple mechanism which will heat and soften the carpet while entering the nip between rollers 2 and 3. The amount of water to be sprayed on is reasonably critical, too little and the softening and setting processes do not occur properly, too much water will cool down the hot roller too much and the setting process is also disturbed.

The pile of the carpet is flattened by squeezing between two pressure rollers 2, 3. The flattening of the pile is due to bending over of the individual tufts to a more horizontal position and then to sideways flattening of these tufts. The latter is similar to flattening yarns. In both cases, the bending of the tufts and the sideways flattening, the resistance is dependent on the stiffness of the fibres which make up the tufts. Due to the nature of the wool fibre it is easier to bend wet and hot fibres than when they are cold/dry, cold/wet or hot/dry.

The heating and wetting of the wool fibres is achieved by using a heated pressure roller 2 as one of the squeeze rollers after the carpet is sprayed with water just before rolling. When the carpet, which has just been sprayed, contacts the hot roller 2 the water will instantly evaporate and because the carpet is becoming constrained between the two rollers the ensuing steam will flow into the pile and heat and wet the pile fibres. These fibres will then distort much easier and the flattening of the pile will take place with much less effort.

Once the pile is flattened it needs to be set temporarily in this position. With wool the usual method of temporary setting is to deform the fibre into the desired position while it is wet and dry the fibre while held in that position. This is achieved either by passing the carpet over another hot roller (not shown) or in many cases by wrapping the carpet around the circumference of the first heated roller.

The idea of the temporary set is not to hold the pile yarns in the desired position forever under all circumstances, which is impossible, but to provide a favourable starting point. When the first footfalls occur on the carpet the pile yarns are oriented in such a way that they cannot go otherwise than further down in the predetermined direction. Only unnatural forces would be able to push the pile yarn in a different way. Once the pile has been pressed down further by the walking forces it is unlikely that the pile will be pushed in a different direction. In theory this is a self reinforcing effect where the temporary set is only needed to start off the anti-shading treatment.

There are a number of treatment parameters of which the most important are:

quantity of water sprayed onto the carpet temperature of the heated roller squeeze pressure between the rollers.

To determine the effect of the amount of water sprayed onto the carpet has on the effectiveness of the treatment a special trial was carried out which also took different levels of roller temperature into account.

The first trials were carried out at a standard heated roller temperature level of 160 degrees. On the particular carpet which was used 150–200 cc/m$^2$ was sufficient to provide the best result, using less water diminished the effect considerably and ruined the appearance of the carpet. Using more water also diminishes the effect but this can be corrected by using a higher temperature of the roller, see below. For most carpets the optimum amount of water appears to be somewhere between 150 and 240 cc/m$^2$ depending on the density of the pile. There seems to be a range of +/−15% around the optimum within which the efficacy of the treatment is satisfactory.

As mentioned above an even distribution of the water over the carpet is important, even if only a small area of the carpet receives less (or more) than the equivalent of 15% less (or more) than the optimum value then this will show up. What also shows up quite dramatically are drops but after shearing this seems to vanish, the area affected by a drop is too small to notice any lack of shading resistance.

It was quite obvious from the Applicant's first trials that increased roller temperature equated to increased anti-shading performance. At this stage the range of temperatures considered was from 120 to 160 degrees as it was not possible to go any higher with a prototype. Therefore when an internal electric radiant heated roller became available where a simple turn of a knob could produce temperatures well over 200 degrees these were tried out with great expectation. However a further increase in performance did not eventuate over approx. 170 degrees and it was necessary to spray more water on at higher temperatures.

It seems that there is an optimal amount of steam to soften the pile before entering the squeezing zone. If less steam is produced by too low a temperature of the roller 2 then the pile is not softened enough and the setting is not satisfactory. If more steam is produced than the optimum due to a higher roller temperature and a larger amount of water then this will still produce a satisfactory result but part of the steam is wasted.

The pressure between the squeeze rollers has also a significant effect on the anti-shading performance of the carpet and as far the Applicant has been able to investigate the higher the pressure the better the performance of the carpet is. However over the restricted number of pressure values performed in trials it appears that at higher pressures the effectiveness of increasing pressure is ever diminishing as is the case with many processes.

Another factor which mitigates against higher pressures is that the pile can be leant over too much and the resulting carpet will look too flat. Because of this and technical reasons a maximum squeeze pressure of 500 kg/m1 was adopted.

There are a number of other parameters which do have a significant influence but because of obvious practical constraints have not been considered. One of these is the number of repeats of the treatment. In the earlier stages of the trials a treatment which consisted of more than one or two passes was considered and trialled. As with most other parameters an increase in the number of passes did improve anti-shading performance but with diminishing effect as the number of passes increased.

When the project entered a more practically oriented phase it was decided to limit the number of passes to one or at the most two as in a continuous finishing line each pass implies another set of rollers.

INDUSTRIAL APPLICABILITY

Thus by this invention there is provided a method and apparatus for laying the pile of a carpet with a preferred orientation and stabilising the pile in that preferred orientation, making the carpet resistant to pile reversal in use and reducing the propensity of the carpet to shade in an objectionable manner.

What is claimed is:

1. A method of laying the pile of a carpet uniformly in one direction and stabilizing the pile in its leaning orientation, the method including the steps of:

treating a carpet to preorient the pile to lay in a preferred direction;

spraying water evenly onto the carpet;

squeezing the carpet between pressure rollers one of which is heated to induce a preferred lean to the pile; and setting at least temporarily the pile in the preferred orientation.

2. A method of laying a pile carpet uniformly in one direction and stabilizing the pile in its leaning orientation as claimed in claim 1, wherein the method includes using a pair of driven compression rollers one of which is heated.

3. A method of laying the pile of a carpet in a preferred orientation and stabilising the pile in its leaning orientation as claimed in claim 2, wherein the pre-orientation treatment is applied by a pre-orientation roller immediately prior to a nip of the pressure rollers.

4. An apparatus suitable for use in the method claimed in claim 1 for laying a pile in a preferred orientation, means for temporarily holding the pile in the preferred orientation, and heating means for thermally annealing the fibres whilst held in the preferred orientation, the means including rollers to transport the pile against a pre-orientation roller to produce a pile lean and to temporarily hold the pile in a preferred laid orientation; a spray mechanism for applying evenly water to the carpet; and a heated roller against which the pile fibers are annealed.

5. An apparatus as claimed in claim 4 wherein the means is incorporated in a carpet finishing line.

* * * * *